US012576896B2

(12) United States Patent
Blouin et al.

(10) Patent No.: US 12,576,896 B2
(45) Date of Patent: Mar. 17, 2026

(54) VEHICLE CONTROL SYSTEMS AND METHODS

(71) Applicant: Transportation IP Holdings, LLC, Norwalk, CT (US)

(72) Inventors: Michael Terrence Blouin, Merriam, KS (US); Eric John Slocombe, Overland Park, KS (US); Andrew Marcus Noyes, Overland Park, KS (US); Jamison Rodney Johnston, Lees Summit, MO (US)

(73) Assignee: Transportation IP Holdings, LLC, Norwalk, CT (US)

( * ) Notice: Subject to any disclaimer, the term of this patent is extended or adjusted under 35 U.S.C. 154(b) by 110 days.

(21) Appl. No.: 18/437,398

(22) Filed: Feb. 9, 2024

(65) Prior Publication Data

US 2025/0074486 A1 Mar. 6, 2025

Related U.S. Application Data

(60) Provisional application No. 63/579,316, filed on Aug. 29, 2023.

(51) Int. Cl.

| | |
|---|---|
| ***B61L 27/04*** | (2006.01) |
| ***B61L 3/12*** | (2006.01) |
| ***B61L 15/00*** | (2006.01) |
| ***B61L 25/02*** | (2006.01) |

(52) U.S. Cl.

CPC ..... *B61L 27/04* (2013.01); *B61L 3/127* (2013.01); *B61L 15/0018* (2013.01); *B61L 25/028* (2013.01)

(58) Field of Classification Search

CPC ..... B61L 27/04; B61L 3/127; B61L 15/0018; B61L 25/028; B60L 2200/26; B60L 2200/30; B60L 15/42; B60L 15/20; G05B 19/04

USPC ..... 701/19, 20

See application file for complete search history.

(56) References Cited

U.S. PATENT DOCUMENTS

| | | | | |
|---|---|---|---|---|
| 8,589,003 | B2 * | 11/2013 | Brand | B61L 15/0072 701/19 |
| 9,200,420 | B2 | 12/2015 | Bramlett | |
| 11,155,135 | B2 | 10/2021 | Blouin et al. | |
| 11,708,101 | B2 * | 7/2023 | Rajanna | B61L 25/025 701/19 |
| 2015/0360700 | A1 * | 12/2015 | Cooper | B61C 17/12 701/2 |

* cited by examiner

*Primary Examiner* — Hai H Huynh
(74) *Attorney, Agent, or Firm* — K&L Gates LLP

(57) ABSTRACT

A vehicle control system and method includes a first controller that controls operation of a first vehicle and is operably coupled with a first communication system. A second controller controls operation of a second vehicle and is operably coupled with a second communication system. The first controller determines an orientation of the second vehicle and identifies a type of the second vehicle. The first controller generates a first set of vehicle control signals based on the orientation and the type of the second vehicle. The first communication system communicates the first set of vehicle control signals with the second communication system. The first controller overrides control of the second vehicle by the second controller to control operation of the first vehicle and the second vehicle according to the first set of vehicle control signals.

20 Claims, 5 Drawing Sheets

VEHICLE CONTROL SYSTEMS AND METHODS

CROSS-REFERENCE TO RELATED APPLICATIONS

This application claims priority to U.S. Provisional Application No. 63/579,316, filed on 29 Aug. 2023. The entirety of this application is incorporated herein by reference.

BACKGROUND

Technical Field

The subject matter described herein relates to systems and methods that control operation of powered systems, such as vehicles or vehicle systems (formed from single or multiple vehicles).

Discussion of Art

Mover vehicles, such as railcar movers, can be found in rail yards or industrial sites for moving single or groups of vehicles to form train consists. These mover vehicles may feature rubber-tired traction wheels for contacting the rails. Such wheels can have a higher coefficient of friction with the rails than steel wheels and are thus able to develop increased pulling power compared to steel wheeled vehicles. In addition to the rubber tires, the vehicles may also have at least one pair of convention steel rail guide wheels.

A regular challenge for operators of railcar movers of this type can be the initiation of movement of a pulled load from a dead stop. The pulled load may range from a single railcar to an extended train of many such cars. Operators need to be skilled at moving the pulled load under a variety of conditions, including when the rails are wet, icy and/or covered with leaves or other debris. Any of these conditions may interfere with traction of the rubber-tired traction wheels.

To begin moving a load, the operator can adjust the vehicle's engine throttle as well as the load on the traction wheels, which can be indirectly controlled by at least one fluid-powered cylinder that controls the height of steel rail guide wheels. By maintaining the rail guide wheels at a desired distance from the draft vehicle, the cylinders can exert a jacking pressure on the vehicle, which also influences the amount of vehicle weight exerted on the rubber-tired traction wheels. Such increase of the vehicle weight applied to the rubber-tired traction wheels can significantly increase traction and facilitate start from a dead stop. However, the tractive effort available from a single railcar mover may not be sufficient to move the railway consist. To increase the tractive effort available to move larger consists of railcars, it may be desirable to couple two or more railcar movers. Such coupling can present challenges for coordinating the control of the engines or prime movers. It may be desirable to have an operational system and method that differs from those that are currently available.

BRIEF DESCRIPTION

In accordance with one example or aspect, a vehicle control system includes a first controller including one or more processors to control operation of a first vehicle. The first controller is operably coupled with a first communication system of the first vehicle. The vehicle control system includes a second controller including one or more processors to control operation of a second vehicle. The second controller is operably coupled with a second communication system of the second vehicle. The first controller determines an orientation of the second vehicle relative to an orientation of the first vehicle and identifies a type of the second vehicle. The first controller generates a first set of vehicle control signals based at least in part on the orientation of the second vehicle and the type of the second vehicle. The first communication system communicates the first set of vehicle control signals with the second communication system. The first controller overrides control of the second vehicle by the second controller to control operation of the first vehicle and the second vehicle according to the first set of vehicle control signals.

In accordance with one example or aspect, a method includes communicatively coupling a first communication system of a first vehicle with a second communication system of a second vehicle. An orientation of the second vehicle relative to an orientation of the first vehicle is determined, and a type of the second vehicle is identified. A first set of vehicle control signals is generated with a first controller based at least in part on the orientation of the second vehicle and the type of the second vehicle. The first set of vehicle control signals are communicated with a second communication system of the second vehicle. The second vehicle includes a second controller to control operation of the second vehicle. Control of the second vehicle by the second controller is overridden to control operation of the first vehicle and the second vehicle according to the first set of vehicle control signals.

In accordance with one example or aspect, a vehicle control system includes a first controller including one or more processors that control operation of a first vehicle, and a first communication system disposed onboard the first vehicle. A second controller includes one or more processors that control operation of a second vehicle. A second communication system is disposed onboard the second vehicle. The first controller determines an orientation of the second vehicle relative to an orientation of the first vehicle, and identifies a type of the second vehicle. The first controller generates a first set of vehicle control signals based at least in part on the orientation of the second vehicle and the type of the second vehicle. The first communication system communicates the first set of vehicle control signals with the second communication system. The first controller controls operation of a propulsion system of the first vehicle according to the first set of vehicle control signals to generate a first amount of tractive effort. The first controller overrides control of a propulsion system of the second vehicle by the second controller to control operation of the propulsion system of the second vehicle according to the first set of vehicle control signals to generate a second amount of tractive effort. The first amount of tractive effort is combined with the second amount of tractive effort to control movement of a load operably coupled with the first and second vehicles.

BRIEF DESCRIPTION OF THE DRAWINGS

The subject matter may be understood from reading the following description of non-limiting embodiments, with reference to the attached drawings, wherein below.

DETAILED DESCRIPTION

Embodiments of the subject matter described herein relate to a vehicle control system and method for communicatively coupling and controlling operation of two or more vehicles. Each of the two or more vehicles may generate tractive effort that may be combined together to control movement of a load. The two or more vehicles may be communicatively coupled together such that one vehicle is capable of remotely controlling operation of the other of the two or more vehicles. For example, a controller of a first vehicle may override a controller of the second vehicle to control operation of the first vehicle and the second vehicle. For example, a first controller of a first vehicle may generate vehicle control signals that may be communicated with a second vehicle. The first controller of the first vehicle may control operation of the first vehicle according to the vehicle control signals, and the first controller of the first vehicle may control operation of the second vehicle according to the vehicle control signals. The first and second vehicles may be controlled to operate according to the vehicle control signals.

While one or more embodiments are described in connection with a rail vehicle system, other embodiments relate to non-rail vehicle systems. Unless expressly disclaimed or stated otherwise, the subject matter described herein extends to other types of vehicle systems, such as automobiles, trucks (with or without trailers), buses, marine vessels, aircraft, mining vehicles, agricultural vehicles, or other off-highway vehicles. The vehicle systems described herein (rail vehicle systems or other vehicle systems that do not travel on rails or tracks) may be formed from a single vehicle or multiple vehicles. With respect to multi-vehicle systems, the vehicles may be mechanically coupled with each other (e.g., by couplers) or logically coupled but not mechanically coupled. For example, vehicles may be logically but not mechanically coupled when the separate vehicles communicate with each other to coordinate movements of the vehicles with each other so that the vehicles travel together (e.g., as a convoy).

Figure 1:
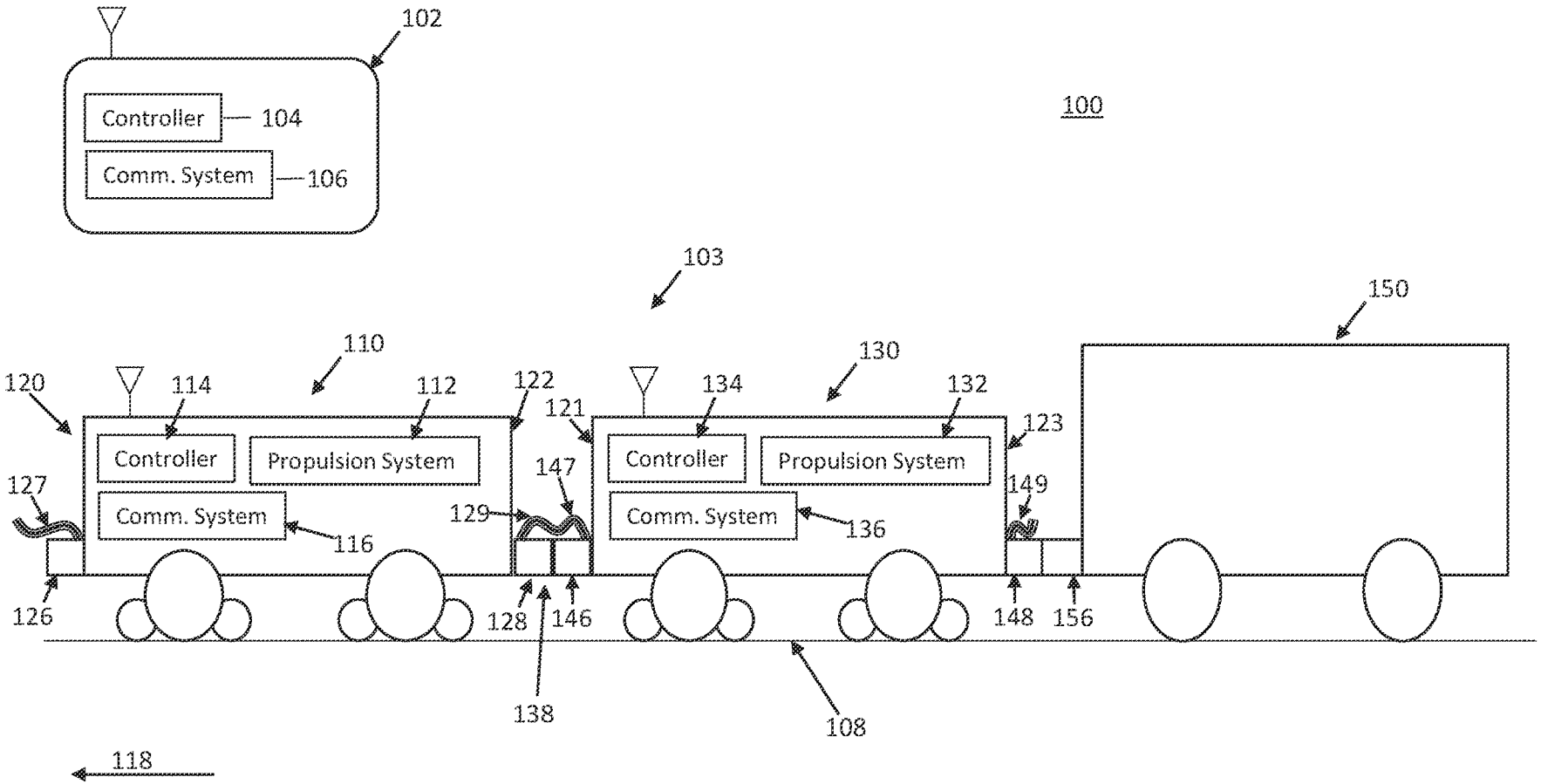
FIG. 1 illustrates a vehicle control system, in accordance with one embodiment.

FIG. 1 illustrates a vehicle control system 100 in accordance with one embodiment. The vehicle control system may include various devices and systems that operate to control operation of one or more vehicles of a vehicle system 103. In the illustrated embodiment, the vehicle system 103 includes a first vehicle 110 and a second vehicle 130 that is mechanically coupled with the first vehicle. The vehicle system can include one or more powered systems, such as vehicles, that may travel together along a route 108. The vehicle system may include one or more vehicles that may be propulsion generating vehicles (e.g., locomotives, switchers, railcar mover vehicles, or the like) that can move along a surface (e.g., a paved and/or non-paved road, a track, or the like). Optionally, the one or more vehicles may be one or more marine vessels, one or more aerial vehicles, or the like. For example, the vehicles may operate and/or communicate together to push, pull, or otherwise move a load along a route. In alternative embodiments, the vehicle system may include less than two or more than two vehicles, and the vehicles may be mechanically coupled, indirectly mechanically coupled (e.g., separated by one or more non-propulsion generating vehicles), or the like. In one or more embodiments, the vehicle system may include any number of propulsion-generating vehicles and any number of non-propulsion-generating vehicles.

In one embodiment, at least one of the first or second vehicles is uncrewed or is not being controlled by an operator (neither onboard or remotely controlled) but rather is able to execute movement operations autonomously. Rather than a mother-mate or slug type system where the uncrewed vehicle is slaved to the crewed vehicle, the uncrewed vehicle decided on operational settings for both itself and for the attached other vehicle. The other vehicle may be crewed (or not) but still receives control signals and operating orders from the uncrewed vehicle. Naturally, the uncrewed vehicle has a controller onboard that can determine an operating plan and can cause that plan to be effectuated. A sensor package may communicate environmental information to the uncrewed vehicle sufficient to provide data upon which the controller may make such operational decisions.

In the illustrated embodiment, the first and second vehicles are mechanically coupled with each other and with a load 150. In one or more embodiments, the load 150 may represent one or more vehicles (e.g., propulsion and/or non-propulsion generating vehicles) operably coupled together, such as a consist or a convoy. The first and second vehicles may operate to control movement of the load, such as in a direction of movement 118 of the vehicle system along the route. In the illustrate embodiment, the first and second vehicles may each generate tractive effort that may be combined together to pull the load in the direction of movement. Optionally, the tractive effort generated by the first and second vehicles may be combined to push the load along the route (e.g., in a direction that is opposite the direction of movement 118).

Figure 2:
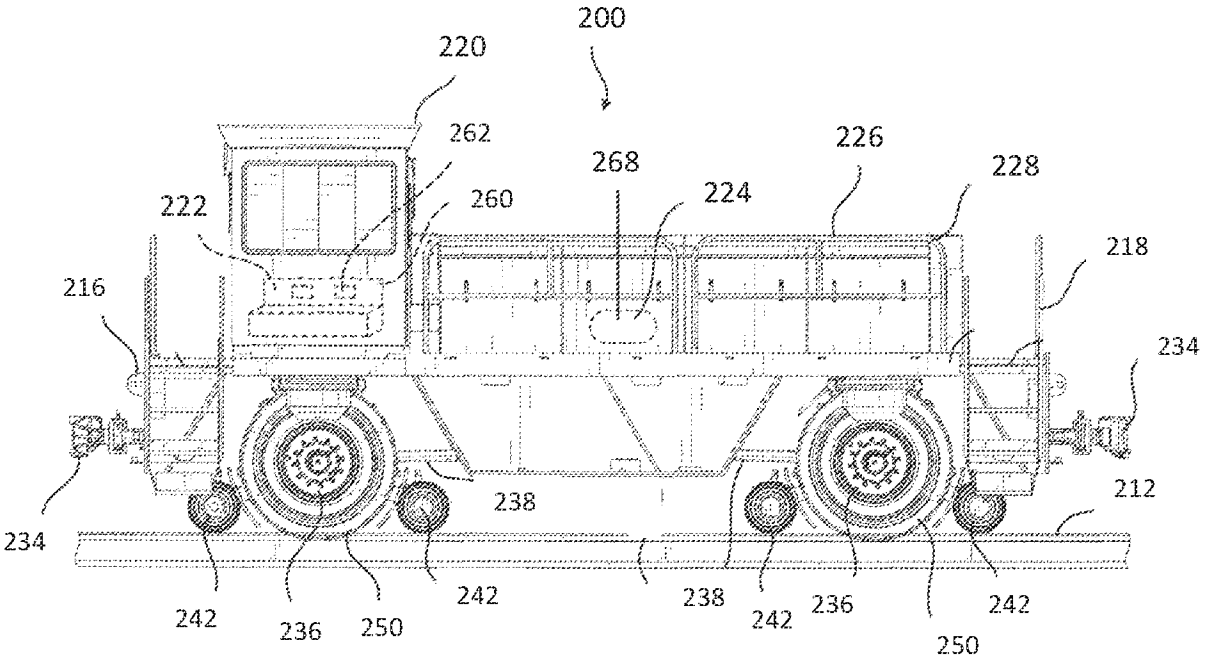
FIG. 2 illustrates a schematic of one example of a vehicle, in accordance with one embodiment.

In one or more embodiments, one or more of the vehicles shown in FIG. 1 may be a railcar mover vehicle. FIG. 2 illustrates a schematic of one example of a railcar mover vehicle 200 in accordance with one embodiment. The railcar mover vehicle may move other vehicles (e.g., railcars, locomotives, trolleys) and/or non-vehicle loads (e.g., carts, flatbeds, or the like) along rails 212, tracks, paved routes, or the like. The railcar mover vehicle can include a frame 214 that has a front end 216 and a rear end 218 that is opposite the front end. A cab 220 can accommodate an operator (not shown) that may control operation of the railcar mover vehicle. In one embodiment, a control panel may be located inside the cab or may be disposed at another location of the vehicle, may be off-board the vehicle, or the like. The control panel may be an interface with which the operator can interact to control movement of the railcar mover car and/or to receive information relative to the railcar mover car, information relative to other vehicles within a determined proximity of the railcar mover car, information relative to other vehicles that are configured to be moved by the railcar mover car, or the like. In one or more embodiments, the control panel may include controls, a display screen (e.g., a touchscreen), lights, audible alarms, a keyboard, electronic mouse, or the like.

The railcar mover vehicle includes a propulsion system 224, that can include and/or represent an engine, one or more motors, alternators, generators, or the like. In one or more embodiments, the propulsion system may be capable of providing a determined amount of power, such as power to control movement of other vehicles (e.g., to push and/or pull other vehicles along the rails). For example, the propulsion system may be capable of generating and/or providing power to tow and/or move plural rail vehicles operably coupled together (e.g., a rail consist) within a rail yard.

In one or more embodiments, the railcar mover vehicle may include rubber-tired traction wheels 236 that engage the rail for pulling other vehicles and/or loads along the rail. Each of the traction wheels may be fitted with a rubber tire 250. The traction wheels can be powered by the propulsion system through at least one driveshaft 238. Additionally or alternatively, the railcar mover vehicle can include one or more guide wheels 242 for each set of traction wheels. The guide wheels may be radially-flanged to move along the rail. In one or more embodiments, each guide wheel can be lowered and raised relative to the frame by means of an actuator (not shown) such as an electric and/or hydraulic controller. In the illustrated embodiment of FIG. 2, the guide wheels are lowered and are engaged with the rail. In one or more embodiments, the positioning of the guide wheels can be used to distribute a weight of the railcar mover vehicle on the rails between the traction wheels and the guide wheels. In one or more embodiments, the application of additional weight distribution from the guide wheels to the tires may provide additional traction between the tire and the rails.

In the illustrated embodiment, the railcar mover vehicle includes couplers 234 provided at the front and rear end of the frame of the vehicle. The couplers may allow the railcar mover vehicle to be operably coupled with a second railcar mover car, to be coupled with another vehicle, to be coupled with a load, or the like.

Returning to FIG. 1, in one or more embodiments, vehicle control system may include an off-board control system 102 that may be communicatively coupled with the vehicle system. In one or more embodiments, the off-board control system may include an off-board controller 104 that represents hardware circuitry connected with and/or including one or more processors that perform the operations described herein in connection with the off-board control system. The off-board control system may represent a dispatch facility, such as a back-office server, a data center, or the like. The off-board control system may include a communication system 106 that allows direct and/or indirect communication between the vehicle system and the off-board control system. The off-board control system may communicate directly with one or more vehicles of the vehicle system, with each propulsion-generating vehicle of the vehicle system, with a lead vehicle of the vehicle system (that may then relay communicated messages between the non-lead vehicles of the vehicle system and the off-board control system), or any combination therein.

In the illustrated embodiment, the first vehicle 110 includes a first controller 114 that represent hardware circuitry connected with and/or including one or more processors that perform one or more operations described herein in connection with the vehicle control system. The applications described herein may direct operation of the vehicle control system and/or other devices. The first vehicle also includes a first propulsion system 112 that can represent one or more components that are powered to generate tractive effort to propel the first vehicle. For example, the first propulsion system can include motors, an engine and/or alternative or generator, or the like. In one or more embodiments, the first propulsion system may be operably coupled with one or more energy storage devices (not shown) that may provide power to one or more components of the first propulsion system. Optionally, the first propulsion system may generate power that may be directed to and stored within the one or more energy storage devices. Suitable energy storage devices may store energy that may be used to power auxiliary and/or non-auxiliary loads of the vehicle system. In one or more embodiments, the auxiliary loads can be powered by the energy storage devices and/or the first propulsion system to perform work that does not propel the vehicle system. For example, the auxiliary loads can include display devices, monitoring devices (e.g., sensors), or the like.

The first vehicle may include a brake system (not shown) that can represent one or more of friction brakes, air brakes, dynamic brakes (e.g., one or more of the traction motors of the propulsion system that also can generate braking effort via dynamic braking), or the like. In one or more embodiments, the first vehicle may include one or more sensors (not shown) that sense characteristics of the first vehicle and/or vehicle system, other devices, the environment around the vehicle system, etc. The first vehicle may include an input/output device (not shown), such as a touchscreen, keyboard, electronic mouse, electronic display other than a touchscreen, switch, lever, button, speaker, microphone, etc., used to present information to and/or receive information from operators of the powered system.

The devices and systems of the first vehicle may be communicatively coupled with each other by a first communication system 116. The first communication system can be formed from communication pathways provided by or extending in conductive pathways (e.g., cables, buses, etc., such as Ethernet cables or connections) and/or wireless pathways. Some devices may be publisher devices or publishers that generate output. Some devices may be listener devices or listeners that obtain or receive the output from the publishers to perform some operation (e.g., control of the powered system, calculation of output, etc.). Some devices may be both publishers and listeners that receive data from another device, make a calculation, determination, etc. based on the received data, and generate data as an output for another device and/or perform some action (e.g., change operation of the powered system, such as changing a speed, throttle setting, etc., of a vehicle).

The second vehicle 130 includes a second controller 134 that represent hardware circuitry connected with and/or including one or more processors that perform one or more operations described herein in connection with the vehicle control system. The second vehicle includes a second propulsion system 132 that can represent one or more components that are powered to generate tractive effort to propel the second vehicle. For example, the second propulsion system can include motors, an engine and/or alternative or generator, or the like.

The second vehicle may include a brake system (not shown) that can represent one or more of friction brakes, air brakes, dynamic brakes (e.g., one or more of the traction motors of the second propulsion system that also can generate braking effort via dynamic braking), or the like. In one or more embodiments, the second vehicle may include one or more sensors (not shown) that sense characteristics of the second vehicle and/or vehicle system, other devices, the environment around the vehicle system, etc. The second vehicle may include an input/output device (not shown), such as a touchscreen, keyboard, electronic mouse, electronic display other than a touchscreen, switch, lever, button, speaker, microphone, etc., used to present information to and/or receive information from operators of the powered system.

In one or more embodiments, the first and/or second vehicles may include a memory (not shown) or other data storage system. In one or more embodiments, the first and/or second vehicles may include a management system (not shown) that represents hardware circuitry including and/or connected with one or more processors, with the memory, or the like, that calculate and/or dictate operational settings of the first vehicle, of the second vehicle, of the vehicle system, or the like. This circuitry and/or the processors may be the same as or separate from (e.g., in addition to) the circuitry and/or processors of the first controller. The management system may calculate settings to achieve one or more goals of the vehicle system subject to various constraints. As one example, the management system can determine a trip plan that dictates operational settings of the vehicle system at different locations, different times, different distances, etc., of upcoming travel of the vehicle system. These operational settings can cause the vehicle system to travel within the constraints (e.g., speed limits, forces exerted on the vehicle and/or the route, remaining a safe distance from other vehicles or objects, or the like) while driving the vehicle system toward achievement of the goal(s) (e.g., reducing fuel consumption, battery energy consumption, emission generation, reduce audible noise, etc.) relative to the vehicle system traveling within the constraints but using other settings. The operational settings can be throttle settings, brake settings, speeds, or the like.

The devices and systems of the second vehicle may be communicatively coupled with each other by a second communication system 136. The second communication system can be formed from communication pathways provided by or extending in conductive pathways (e.g., cables, buses, etc., such as Ethernet cables or connections) and/or wireless pathways.

In one or more embodiments, the first and/or second vehicles may be powered by one or more different fuel and/or energy types. With respect to the fuel, the fuel may be a single fuel type in one embodiment and in other embodiments the fuel may be a mixture of a plurality of different fuels. In one example of a fuel mixture, a first fuel may be liquid and a second fuel may be gaseous. A suitable liquid fuel may be diesel (regular, biodiesel, HDRD, and the like), gasoline, kerosene, dimethyl ether (DME), alcohol, and the like. A suitable gaseous fuel may be natural gas (methane) or a short chain hydrocarbon, hydrogen, ammonia, and the like. In one embodiment, fuel may be inclusive of stored energy as used herein. In that perspective, a battery state of charge, or a source of compressed gas, a flywheel, fuel cell, and other types of non-traditional fuel sources may be included. Optionally, the vehicle and/or vehicle system may be powered by electric energy (e.g., direct and/or alternating current). One or more energy sources may provide the electric energy to one or more loads, and the energy sources may include one or more fuel cells.

In one or more embodiments, the first vehicle may be similar to or substantially the same as the second vehicle. For example, the first and second vehicles may be the same or may be similar types of vehicles, the same or similar makes and/or models, may include the same and/or similar systems and/or components, or the like. In one or more embodiments, the first and second vehicles may each include an engine or other propulsion-generating system that are capable of generating the same or substantially the same amount of tractive effort (e.g., within about 5% of each other, within about 10% of each other, or the like).

Alternatively, the first vehicle may be different than the second vehicle. For example, the first vehicle may include a power-generating system (e.g., an engine, or the like) that is capable of generating a first amount of tractive effort, and the second vehicle may include a power-generating system (e.g., an engine, or the like) that is capable of generating a second amount of tractive effort, wherein the second amount of tractive effort is different than the first amount of tractive effort generated by the first propulsions system of the first vehicle. The tractive effort that is generated by the first vehicle may be combined with the tractive effort that is generated by the second vehicle to control movement of the load(s) 150.

The first vehicle includes a first coupler 126 that is disposed at a first end 120 of the first vehicle, and a second coupler 128 that is disposed at a second end 122 of the first vehicle. The second vehicle includes a third coupler 146 that is disposed at a first end 121 of the second vehicle, and a fourth coupler 148 that is disposed at a second end 123 of the second vehicle. The couplers of the first and second vehicle may be the compatible with each other, such that the first and second couplers of the first vehicle may be capable of being connected to either the third and/or fourth couplers of the second vehicle. Additionally, the load includes a load coupler 156 that is compatible with any of the couplers of the first and/or second vehicles.

The first communication system 116 of the first vehicle also includes a first communication cable 127 that is accessible from the first end of the first vehicle, and a second communication cable 129 that is accessible from the second end of the first vehicle. In one or more embodiments, the first and second communication cables may include one or more coupling features or components that allow the first and second communication cables to be electrically and mechanically coupled with another cable, with an electrical connection, or the like. The first and second communication cables may be operably coupled with (e.g., via wired and/or wireless connections) the first controller of the first vehicle, the communication system of the off-board control system, or the like.

The second communication system 136 of the second vehicle includes a third communication cable 147 that is accessible from the first end of the second vehicle, and a fourth communication cable 149 that is accessible from the second end of the second vehicle. In one or more embodiments, the third and fourth communication cables may include one or more coupling features or components that allow the third and fourth communication cables to be electrically and mechanically coupled with another cable, with an electrical connection, or the like.

In one or more embodiments, the first, second, third, and fourth communication cables may allow the first and second communication systems to communicate via a standard wired protocol (e.g., SAE J1939, RS422, or the like). Optionally, the communication cables may allow the first and second communication systems to communicate via an alternative wired protocol or method, such as using ethernet to communicate, discrete and/or analog signals that drive components of the connected vehicles, or the like.

In the illustrated embodiment, the second communication cable 129 of the first vehicle (e.g., that is disposed at the second end 122 of the first vehicle) is electrically and mechanically coupled with the third communication cable 147 of the second vehicle (e.g., that is disposed at the first end 121 of the second vehicle). Additionally, the second coupler of the first vehicle is mechanically coupled with the third coupler of the second vehicle to form a coupling system 138. The load coupler of the load is mechanically coupled with the fourth coupler of the second vehicle to mechanically couple the load with the first and second vehicles to form the vehicle system.

In the illustrated embodiment, the first, second, third, and fourth communication cables are disposed proximate to the corresponding first, second, third, and fourth couplers of the first and second vehicles. Optionally, one or more of the communication cables may be disposed at another location or position of the first and/or second vehicles, respectively. For example, the second communication cable 129 may not extend outside of the second end 122 of the first vehicle, and may include a coupling connection proximate to the second end of the first vehicle that allows the third communication cable to be electrically and mechanically coupled with the second communication cable.

In one or more embodiments, one of the first controller of the first vehicle or the second controller of the second vehicle may be referred to as a multiple-unit (MU) controller such that the first or second controllers may include and/or incorporate programmed computer processor control over one or more vehicles. For example, the first controller may be capable of controlling one or more operations (e.g., propulsion settings, brake settings, or the like) of the second vehicle. As another example, the second controller onboard the second vehicle may be the multi-unit controller, and may be capable of controlling one or more operations of the first vehicle. For example, controlling the propulsion settings and/or brake settings of the first and second vehicles allows the first and second vehicles to generate tractive effort that can be combined together to control movement of the load.

One of the first or second controllers may generate and communicate control signals to the other of the first or second controllers via the communication cables. The control signals may allow the first or second controller to automatically control one or more operational settings of the other vehicle. For example, one of the first or second controllers may be able to override control of the other vehicle by the other controller and remotely and automatically control operation of the propulsion system of the other vehicle (e.g., without operator input).

In one embodiment, the first controller may represent the MU controller and may generate one or more vehicle control signals that direct the first and second vehicles how to operate. The first communication system may communicate the vehicle control signals to the second vehicle via the second communication cable 129 that is electrically and mechanically coupled with the third communication cable 147 of the second vehicle. In another embodiment, the second controller may represent the MU controller and may generate vehicle control signals that direct the first and second vehicles how to operate. The second communication system may communicate the vehicle control signals to the first vehicle via the third communication cable that is electrically and mechanically coupled with the second communication cable of the first vehicle.

In another embodiment, the off-board controller 104 may represent the MU controller and may generate one or more vehicle control signals that direct the first and second vehicles how to operate. The off-board communication system may wirelessly communicate the vehicle control signals to the first vehicle and/or the second vehicle. In one embodiment, the off-board communication system may wirelessly communicate the vehicle control signals to both the first and second vehicles. In another embodiment, the off-board communication system may wirelessly communicate the vehicle control signals to one of the first or second vehicles, and the first or second vehicle may communicate the control signals via the communication cables to the other of the first or second vehicle to control operation of the other vehicle.

Figure 3:
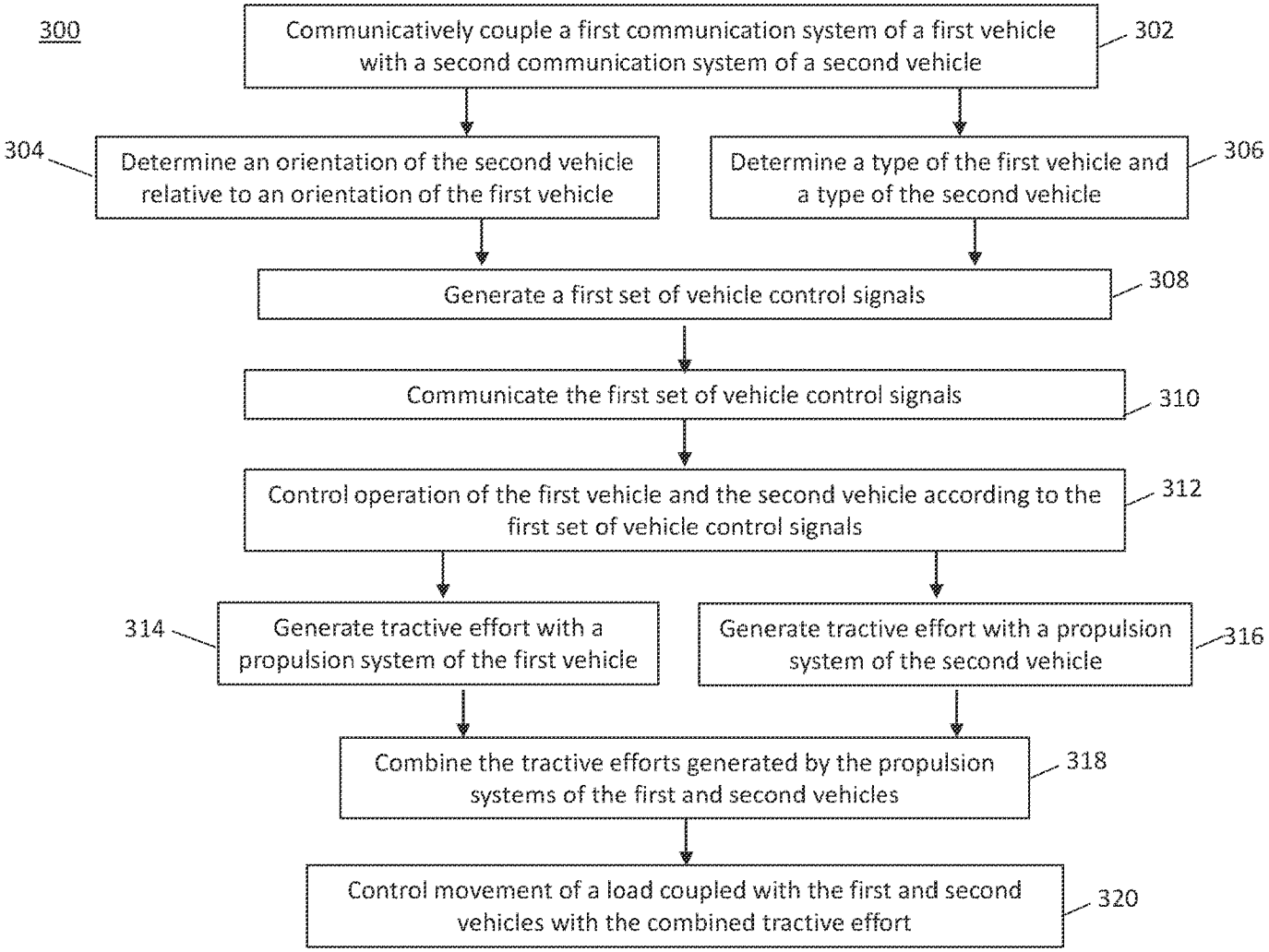
FIG. 3 illustrates a flowchart of one example of a method for communicatively coupling and controlling operation of two or more vehicles, according to one embodiment.

In one or more embodiments, the type and/or arrangement of the first and second vehicles relative to each other may need to be understood in order for the MU controller to determine how the first and second vehicles are to operate and to generate vehicle control signals. For example, FIG. 3 illustrates a flowchart 300 of one example of a method for communicatively coupling and controlling operation of two or more vehicles, according to one embodiment. In one or more embodiments, one or more steps of the method may be omitted, may be completed in an alternative order, may be duplicated, or any combination therein.

At step 302, a first communication system of a first vehicle may be communicatively coupled with a second communication system of a second vehicle. In the illustrated embodiment shown in FIG. 1, the first communication system 116 of the first vehicle is communicatively coupled with the second communication system 136 of the second vehicle via the second communication cable 129 being operably coupled with the third communication cable 147. In alternative embodiments, the first and second communication systems may be communicatively coupled via wireless communication pathways. In another embodiment, one or both of the first and second communication systems may be wirelessly communicatively coupled with the off-board communication system.

In one embodiment, the communication systems of the first and second vehicle, and/or the off-board controller, can interact with each other and/or other systems via one or more communication types. Suitable communication types can include, but are not limited to, cellular networks (e.g., the Global System for Mobile Communications (GSM)), mesh networks using Ethernet standards, wireless communication methods and/or protocols (e.g., Bluetooth, a bit-banging transmission of signals, or the like), wired communication systems and/or protocols (e.g., SAE-J1939, RS422, or the like), radio and shortwave communication types, or the like.

In one or more embodiments, where two or more communication types are present, one or more of the communication systems may translate some or all of a data stream from one type to another. Similarly, different data protocols may be used. Such translation may allow one or more of the communication systems to act as a transference point for data transmission. The translation may allow for different types of equipment (e.g., first and second vehicles may each use communication types different from each other to communicate with each other via the communication system). The communication systems may switch types, protocols, and/or communication pathways in response to delegation of signal or failure of one pathway. This may provide redundancy of communication by the communication system. In one embodiment, one or more of the communication systems may decrypt, decompile, or disaggregate information, parse information, and send along all or part of a message (e.g., alone or combined with new data, or with encryption, or both). Optionally, the communication systems may be the same as or similar to other communication systems or communication devices described herein.

At step 304, an orientation of the second vehicle is determined relative to an orientation of the first vehicle. In the illustrated embodiment shown in FIG. 1, the first and second vehicles have a common orientation. For example, the first end 120 of the first vehicle is facing in the direction of movement 118 of the vehicle system. Additionally, the first end 121 of the second vehicle is also facing in the direction of movement of the vehicle system. For example, the second end 122 of the first vehicle is facing towards the first end 121 of the second vehicle such that the second coupler 128 of the first vehicle is operably coupled with the third coupler 146 of the second vehicle. Additionally, the second communication cable 129 is operably coupled with the third communication cable 147.

Figure 6A:
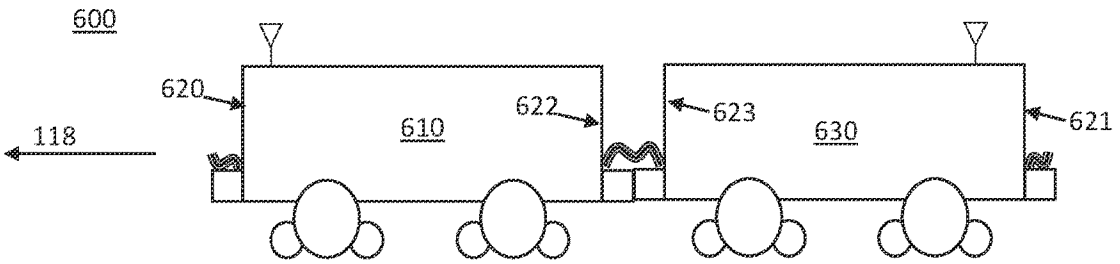
FIG. 6A illustrates a first example of orientations of two vehicles operably coupled together, in accordance with one embodiment.
Figure 6B:
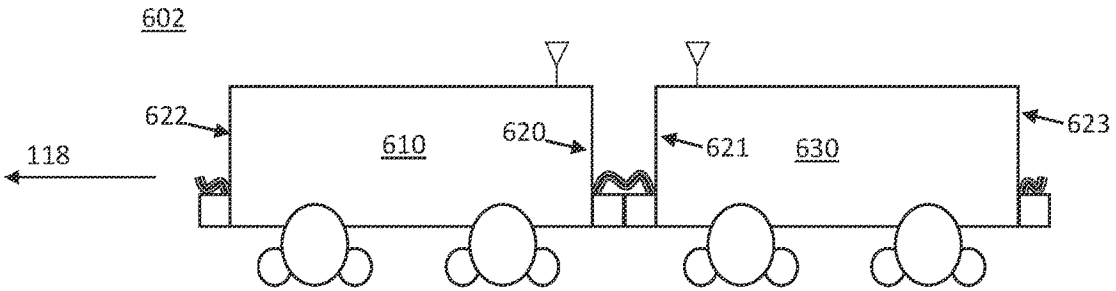
FIG. 6B illustrates a second example of orientations of two vehicles operably coupled together, in accordance with one embodiment.
Figure 6C:
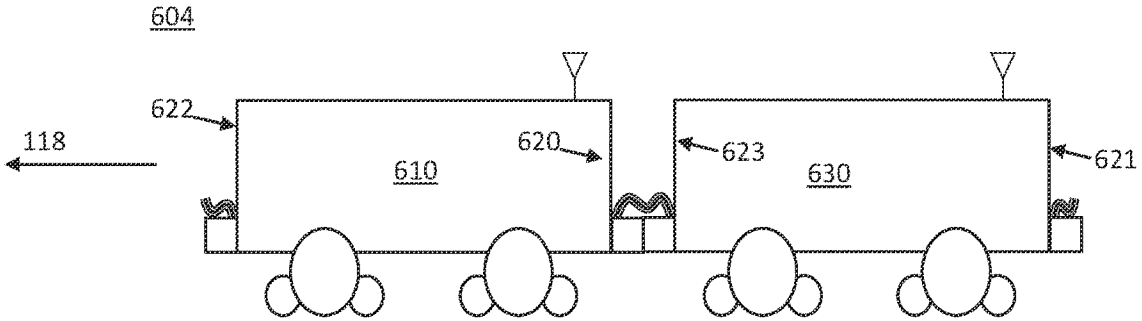
FIG. 6C illustrates a third example of orientations of two vehicles operably coupled together, in accordance with one embodiment.

In one or more embodiments, the first and/or second vehicles may have alternative orientations relative to the direction of movement of the vehicle system. FIGS. 6A-6C illustrate alternative examples of an orientation of the first vehicle relative to an orientation of the second vehicle. For example, FIG. 6A illustrates a first arrangement 600 that includes a first vehicle 610 that is orientated with a first end 620 facing in the direction of movement of the vehicle system. A second vehicle 630 is orientated with a second end 623 of the second vehicle facing the direction of movement of the vehicle system. For example, a second end 622 of the first vehicle is operably coupled with the second end 623 of the second vehicle.

In another example, FIG. 6B illustrates a second arrangement 602 that includes the first vehicle 610 oriented with the second end 622 of the first vehicle facing toward the direction of movement 118 of the vehicle system, and the second vehicle 630 oriented with the first end 621 of the second vehicle facing toward the direction of movement of the vehicle system. For example, the first end 620 of the first vehicle is facing towards and is operably coupled with the first end 621 of the second vehicle.

In another example, FIG. 6C illustrates a third arrangement 604 that includes the first vehicle oriented with the second end of the first vehicle facing toward the direction of movement of the vehicle system, and the second vehicle oriented with the second end of the second vehicle facing toward the direction of movement of the vehicle system. For example, the first end of the first vehicle is facing towards and is operably coupled with the second end of the second vehicle.

In one or more embodiments, the first controller of the first vehicle may receive one or more signals from the second vehicle, and the first controller may determine the orientation of the second vehicle, relative to the orientation of the first vehicle, based at least in part on the one or more signals from the second vehicle. For example, the first and second communication cables, and the third and fourth communication cables, may be setup to communicate unique signals and/or messages, such as to the first controller. The orientations of the first and/or second vehicles may be determined based on the unique messages, based on an identification of the messages, or the like.

In one or more embodiments, the orientation of the second vehicle may be determined relative to the orientation of the first vehicle based on a voltage detection of one or more different resistive network circuits. For example, the second communication cable being operably coupled with the third communication cable (e.g., illustrated in FIG. 1) may generate a first state of a voltage conducted between the second and third communication cables. Alternatively, the second communication cable being operably coupled with the fourth communication cable (e.g., illustrated in FIG. 6A) may generate a second state of the voltage conducted between the second and fourth communication cables.

In one or more embodiments, the orientation of the first vehicle and/or the orientation of the second vehicle may be manually determined and/or entered (e.g., into the first and/or second controllers) by one or more operators of the vehicle system. The operator(s) may be onboard one of the vehicle systems, may be located off-board the vehicle system, or the like. Optionally, the orientation of the first vehicle and/or the orientation of the second vehicle may be determined based on a discrete signal of a forward-facing connector relative to a different, discrete signal of a rearward-facing connector. For example, the first end of the first vehicle may be associated with a first pin, and the second end of the first vehicle may be associated with a second pin. Additionally, the first end of the second vehicle may be associated with a third pin, and the second end of the second vehicle may be associated with a fourth pin. The first and/or second controllers may monitor the first, second, third, and/or fourth pins to determine how the first and second vehicles are oriented.

In one or more embodiments, the first and/or second controllers may lock out the coupling system 138 responsive to the determination of the orientation of the second vehicle relative to the orientation of the first vehicle. For example, the first and/or second controllers may prohibit the coupler of the first vehicle that is operably coupled with the coupler of the second vehicle from disengaging or otherwise separating. Optionally, coupling commands of the first and second vehicles may be based on the orientations of the first and second vehicles. For example, in the illustrated embodiment of FIG. 1, the rear coupling commands of the first vehicle (e.g., of the second coupler 128 may be transferred to the rear coupling commands of the second vehicle (e.g., of the fourth coupler 148) such that the first and second vehicles may operate and/or function as a single vehicle. For example, the second end of the second vehicle (e.g., the fourth coupler) may be controlled to function as the second end of the first vehicle (e.g., the second coupler) would be controlled if the first and second vehicles were not mechanically coupled together.

Returning to FIG. 3, at step 306, a type of the first vehicle and a type of the second vehicle may be determined. The type of the first and second vehicle may be based on the make of the vehicles, the model of the vehicles, a series and/or other classification of the vehicles, or the like. Optionally, the type of the first and second vehicles may be based on the make, model, type, and/or classification of the propulsion systems of the vehicles. For example, the propulsion system of the first vehicle may include an engine that is capable of generating a first amount of tractive effort, and the propulsion system of the second vehicle may include an engine that is capable of generating a second amount of tractive effort. The first and second amounts of tractive effort may be the same or substantially the same (e.g., within about 2%, within about 5%, within about 10%, within about 20%, or the like), or the first and second amounts of tractive effort may be different.

Figure 4:
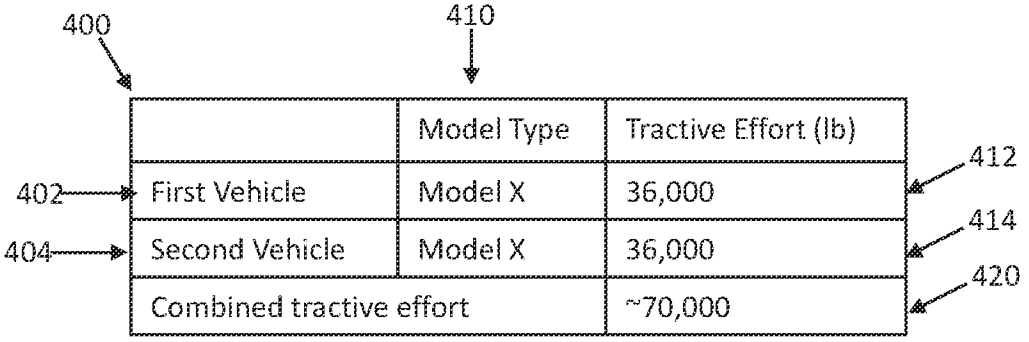
FIG. 4 illustrates a table of one example of combined tractive effort generated by plural vehicles, in accordance with one embodiment.
Figure 5:
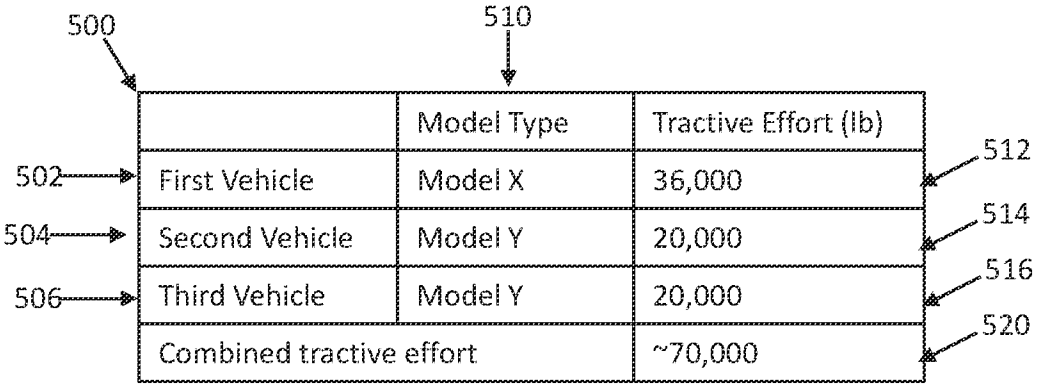
FIG. 5 illustrates a table of another example of combined tractive effort generated by plural vehicles, in accordance with one embodiment.

For example, FIG. 4 illustrates a table 400 that indicates types 410 of first and second vehicles 402, 404. In the illustrated example, the first vehicle has a type (e.g., make, model, classification, series, or the like) that is the same as the type of the second vehicle. The first vehicle, operating at a first operating setting, is capable of generating a first amount of tractive effort 412, and the second vehicle, operating at the same first operating setting as the first vehicle, is capable of generating a second amount of tractive effort 414, that is substantially the same as the first amount of tractive effort. The first and second amounts of tractive effort may be combined to create a combined tractive effort 420 that may be used to control movement of the load (shown in FIG. 1).

Figure illustrates a table 500 of vehicle types in accordance with another example. In the illustrated embodiment, a first vehicle 502 is identified as being a first type of vehicle, a second vehicle 504 is identified as being a second type of vehicle, and a third vehicle 506 is identified as being the same second type of vehicle. The first vehicle, operating at a first operating setting, is capable of generating a first amount of tractive effort 512, the second vehicle, operating at the same first operating setting, is capable of generating a second amount of tractive effort 514 (that is different than the first amount of tractive effort), and the third vehicle, operating at the same first operating setting, is capable of generating a third amount of tractive effort 516 (that is the same or substantially the same as the second amount of tractive effort generated by the second vehicle). The first, second, and third amounts of tractive effort may be combined to create a combined tractive effort 520 that may be used to control movement of the load.

Returning to FIG. 3, at step 308, responsive to the orientations of the first and second vehicles being determined, and the types of the first and second vehicles being determined, a first set of vehicle control signals may be generated. In one or more embodiments, the first vehicle may be referred to as the prime vehicle, the lead vehicle, or the like, and the first controller 114 of the first vehicle may generate the first set of vehicle control signals that may be used to control operation of the first and second vehicles. Optionally, the off-board controller may generate the first set of vehicle control signals, and may wirelessly communicate the first set of vehicle control signals with the first and/or second vehicles. Optionally, the second vehicle may be referred to as the prime vehicle, and the second controller 134 of the second vehicle may generate the first set of vehicle control signals.

The first set of vehicle control signals may be based at least in part on the types of the first and/or second vehicles, the orientations of the first and/or second vehicles, the load that the first and second (and/or additional vehicles) may be configured to move, or the like. Optionally, the first set of vehicle control signals may be based on one or more additional and/or alternative factors, such as ambient conditions (e.g., temperature, humidity, pressure, or the like), the presence or absence of precipitation (e.g., rain, snow, sleet, fog, or the like), the geographic location of the vehicle system (e.g., an elevation level of the route), based on travel plans and/or locations of other vehicle systems, other loads that need to be moved (e.g., within a railyard), or the like.

At step 310, the first set of vehicle control signals may be communicated between the first and second communication systems. In one embodiment, the first controller may generate the first set of vehicle control signals and may communicate the first set of vehicle control signals with the second communication system. In another embodiment, the second controller may generate the first set of vehicle control signals and may communicate the first set of vehicle control signals with the first communication system. In another embodiment, the off-board controller may generate the first set of vehicle control signals and may communicate the first set of vehicle control signals with one or both of the first or second communication systems. Optionally, the first communication system may receive the first set of vehicle control signals from the off-board controller, and may relay the control signals to the second communication system.

At step 312, the first and second vehicles may be controlled to operate according to the first set of vehicle control signals. For example, both of the first and second vehicles may be controlled to operate according to the first set of vehicle control signals without operator intervention. In one or more embodiment, the first controller communicating the first set of vehicle control signals with the second vehicle may allow the first controller to remotely and/or automatically control operation of the second vehicle according to the first set of vehicle control signals. For example, the first controller may override control of the second vehicle by the second controller. The first and second vehicles may be controlled to operate together in unison, such as a single vehicle. For example, the first vehicle and the second vehicle operating in unison may be similar to a single, larger vehicle that is capable of generating combined tractive efforts that may otherwise be separately and/or independently generated by the first vehicle and the second vehicle. Optionally, operating the first and second vehicles together allows the first and second vehicles to operate as a single vehicle that is capable of generating the combined first and second amounts of tractive effort.

In one or more embodiments, the first set of vehicle control signals may indicate operating settings of the first and second vehicles. For example, the first set of vehicle control signals may indicate and/or instruct the first vehicle to operate according to a first operating setting (e.g., a first throttle or notch setting, a first brake setting, or the like), and may indicate and/or instruct the second vehicle to operate according to a second operating setting. In one or more embodiments, responsive to the first and second vehicles being the same or common types, the first operating setting of the first vehicle may be substantially the same as the second operating setting of the second vehicle. For example, the first and second vehicles may be controlled to operate according to the same operating settings (e.g., the same throttle or notch setting, or the like). Alternatively, responsive to the first and second vehicles being different types of vehicles, the first operating setting may be different than the second operating setting of the second vehicle. For example, the first operating setting may direct the first vehicle to operate at a level 2 notch setting, and the second operating setting may direct the second vehicle to operate at a level 4 notch setting.

At step 314, the first propulsion system of the first vehicle may generate a first amount of tractive effort responsive to the first vehicle being controlled to operate according to the first set of vehicle control signals. Additionally, at step 316, the second propulsion system of the second vehicle may generate a second amount of tractive effort responsive to the second vehicle being controlled to operate according to the first set of vehicle control signals.

At step 318, the first and second amounts of tractive effort generated by the first and second propulsion systems, respectively, may be combined. For example, the first propulsion system may generate a first amount of tractive effort, and the second propulsion system may generate a second amount of tractive effort that may be combined with the first amount of tractive effort to control movement of the load. At step 320, movement of the load(s) operably coupled with the first and second vehicles may be controlled at least in part on the combined tractive effort of the first and second vehicles.

In one or more embodiments, responsive to the first and second vehicles being controlled to operate according to the first set of vehicle control signals, the first or second controller may receive one or more signals from the other of the first or second controller. The one or more signals may include and/or be indicative of one or more operating conditions of the other vehicle. For example, the first controlled may receive the signals from the second controller that indicate operating conditions of the second vehicle. In one or more embodiments, the signals may indicate that an amount of traction between the wheels of the second vehicle and the route is less than an expected or anticipated amount of traction. For example, one or more wheels of the second vehicle may be experiencing slippage or may be slipping relative to the route. In one or more embodiments, the first controller may determine a second set of vehicle control signals based at least in part on the one or more signals received from the second vehicle. For example, the second set of vehicle control signals may include a different throttle or notch setting, such as to compensate for the slippage between the one or more wheels of the second vehicle and the route. The first communication system may communicate the second set of vehicle control signals with the second controller to control operation of the second vehicle according to the second set of vehicle control signals.

In one embodiment, the vehicle control system, the off-board controller, the first controller, and/or the second controller may have a local data collection system deployed that may use machine learning to enable derivation-based learning outcomes. The vehicle control system may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and behavior analytics, and the like.

In one embodiment, the vehicle control system may include a policy engine that may apply one or more policies. These policies may be based at least in part on characteristics of a given item of equipment or environment. With respect to control policies, a neural network can receive input of a number of environmental and task-related parameters. These parameters may include an identification of a determined trip plan for a vehicle group, data from various sensors, and location and/or position data. The neural network can be trained to generate an output based on these inputs, with the output representing an action or sequence of actions that the vehicle group should take to accomplish the trip plan. During operation of one embodiment, a determination can occur by processing the inputs through the parameters of the neural network to generate a value at the output node designating that action as the desired action. This action may translate into a signal that causes the vehicle to operate. This may be accomplished via back-propagation, feed forward processes, closed loop feedback, or open loop feedback. Alternatively, rather than using backpropagation, the machine learning system of the vehicle control system may use evolution strategies techniques to tune various parameters of the artificial neural network. The vehicle control system may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle control system executes that plan to achieve the desired input data to mirror the predicted best outcome scenario. Additionally, the success metric may be a combination of the optimized outcomes, which may be weighed relative to each other.

The vehicle control system can use this artificial intelligence or machine learning to receive input (e.g., a location or change in location), use a model that associates locations with different operating modes to select an operating mode of the one or more functional devices of the HOV unit and/or EOV unit, and then provide an output (e.g., the operating mode selected using the model). The vehicle control system may receive additional input of the change in operating mode that was selected, such as analysis of noise or interference in communication signals (or a lack thereof), operator input, or the like, that indicates whether the machine-selected operating mode provided a desirable outcome or not. Based on this additional input, the vehicle control system can change the model, such as by changing which operating mode would be selected when a similar or identical location or change in location is received the next time or iteration. The vehicle control system can then use the changed or updated model again to select an operating mode, receive feedback on the selected operating mode, change or update the model again, etc., in additional iterations to repeatedly improve or change the model using artificial intelligence or machine learning.

In accordance with one example or aspect, a vehicle control system includes a first controller including one or more processors to control operation of a first vehicle. The first controller is operably coupled with a first communication system of the first vehicle. The vehicle control system includes a second controller including one or more processors to control operation of a second vehicle. The second controller is operably coupled with a second communication system of the second vehicle. The first controller determines an orientation of the second vehicle relative to an orientation of the first vehicle and identifies a type of the second vehicle. The first controller generates a first set of vehicle control signals based at least in part on the orientation of the second vehicle and the type of the second vehicle. The first communication system communicates the first set of vehicle control signals with the second communication system. The first controller overrides control of the second vehicle by the second controller to control operation of the first vehicle and the second vehicle according to the first set of vehicle control signals.

Optionally, the first controller may receive one or more signals from the second controller, and the first controller may determine the orientation of the second vehicle relative to the orientation of the first vehicle based at least in part on the one or more signals. Optionally, the first communication system may be communicatively coupled with the second communication system via one or more of a wired communication pathway or a wireless communication pathway. Optionally, the first controller may remotely control operation of the second vehicle via the first set of vehicle control signals. Optionally, the first vehicle may operate at a first operating setting and the second vehicle may operate at the first operating setting based at least in part on the first set of vehicle control signals. Optionally, a propulsion system of the first vehicle may generate a first amount of tractive effort responsive to the first vehicle operating at the first operating setting, and a propulsion system of the second vehicle may generate a second amount of tractive effort responsive to the second vehicle operating at the first operating setting. Optionally, the first amount of tractive effort generated by the propulsion system of the first vehicle may be combined with the second amount of tractive effort generated by the propulsion system of the second vehicle to control movement of a load operably coupled with the first and second vehicles. Optionally, the first controller may determine that the propulsion system of the first vehicle is the same as the propulsion system of the second vehicle based at least in part on the type of the second vehicle. The first amount of tractive effort generated by the propulsion system of the first vehicle operating at the first operating setting may be substantially the same as the second amount of tractive effort generated by the second propulsion system of the second vehicle operating at the first operating setting. Optionally, the first controller may determine that the propulsion system of the first vehicle is different than the propulsion system of the second vehicle based at least in part on the type of the second vehicle. The first amount of tractive effort generated by the propulsion system of the first vehicle operating at the first operating setting may be different than the second amount of tractive effort generated by the propulsion system of the second vehicle operating at the first operation setting. Optionally, the first vehicle may be operably coupled with the second vehicle via a coupling system. Optionally, the first controller may receive one or more signals from the second controller indicative of one or more operating conditions of the second vehicle responsive to the second vehicle operating according to the first set of vehicle control signals. Optionally, the first controller may generate a second set of vehicle control signals based at least in part on the one or more signals received from the second controller. The first communication system may communicate the second set of vehicle control signals to the second communication system. The first controller may override control of the second vehicle by the second controller to control operation of the first vehicle and the second vehicle according to the second set of vehicle control signals.

In accordance with one example or aspect, a method includes communicatively coupling a first communication system of a first vehicle with a second communication system of a second vehicle. An orientation of the second vehicle relative to an orientation of the first vehicle is determined, and a type of the second vehicle is identified. A first set of vehicle control signals is generated with a first controller based at least in part on the orientation of the second vehicle and the type of the second vehicle. The first set of vehicle control signals are communicated with a second communication system of the second vehicle. The second vehicle includes a second controller to control operation of the second vehicle. Control of the second vehicle by the second controller is overridden to control operation of the first vehicle and the second vehicle according to the first set of vehicle control signals.

Optionally, the method may include receiving one or more signals from the second controller, and determining the orientation of the second vehicle relative to the first vehicle based at least in part on the one or more signals. Optionally, the method may include operating the first vehicle at a first operating setting based at least in part on the first set of vehicle control signals, and operating the second vehicle at the first operating setting based at least in part on the first set of vehicle control signals. Optionally, the method may include generating a first amount of tractive effort with a propulsion system of the first vehicle responsive to the first vehicle operating at the first operating setting, and generating a second amount of tractive effort with a propulsion system of the second vehicle responsive to the second vehicle operating at the first operating setting. Optionally, the method may include combining the first amount of tractive effort generated by the propulsion system of the first vehicle with the second amount of tractive effort generated by the propulsion system of the second vehicle, and controlling movement of a load operably coupled with the first and second vehicles with the combined first and second amounts of tractive effort. Optionally, the method may include determining that the propulsion system of the first vehicle is different than the propulsion system of the second vehicle based at least in part on the type of the second vehicle; generating the first amount of tractive effort with the propulsion system of the first vehicle responsive to the first vehicle operating at the first operating setting; and generating the second amount of tractive effort with the propulsion system of the second vehicle responsive to the second vehicle operating at the first operating setting. The first amount of tractive effort generated by the propulsion system of the first vehicle is different than the second amount of tractive effort generated by the propulsion system of the second vehicle.

In accordance with one example or aspect, a vehicle control system includes a first controller including one or more processors that control operation of a first vehicle, and a first communication system disposed onboard the first vehicle. A second controller includes one or more processors that control operation of a second vehicle. A second communication system is disposed onboard the second vehicle. The first controller determines an orientation of the second vehicle relative to an orientation of the first vehicle, and identifies a type of the second vehicle. The first controller generates a first set of vehicle control signals based at least in part on the orientation of the second vehicle and the type of the second vehicle. The first communication system communicates the first set of vehicle control signals with the second communication system. The first controller controls operation of a propulsion system of the first vehicle according to the first set of vehicle control signals to generate a first amount of tractive effort. The first controller overrides control of a propulsion system of the second vehicle by the second controller to control operation of the propulsion system of the second vehicle according to the first set of vehicle control signals to generate a second amount of tractive effort. The first amount of tractive effort is combined with the second amount of tractive effort to control movement of a load operably coupled with the first and second vehicles.

Use of phrases such as "one or more of . . . and," "one or more of . . . or," "at least one of . . . and," and "at least one of . . . or" are meant to encompass including only a single one of the items used in connection with the phrase, at least one of each one of the items used in connection with the phrase, or multiple ones of any or each of the items used in connection with the phrase. For example, "one or more of A, B, and C," "one or more of A, B, or C," "at least one of A, B, and C," and "at least one of A, B, or C" each can mean (1) at least one A, (2) at least one B, (3) at least one C, (4) at least one A and at least one B, (5) at least one A, at least one B, and at least one C, (6) at least one B and at least one C, or (7) at least one A and at least one C.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in another device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

As used herein, an element or step recited in the singular and preceded with the word "a" or "an" do not exclude the plural of said elements or operations, unless such exclusion is explicitly stated. Furthermore, references to "one embodiment" of the invention do not exclude the existence of additional embodiments that incorporate the recited features. Moreover, unless explicitly stated to the contrary, embodiments "comprising," "comprises," "including," "includes," "having," or "has" an element or a plurality of elements having a particular property may include additional such elements not having that property. In the appended claims, the terms "including" and "in which" are used as the plain-English equivalents of the respective terms "comprising" and "wherein." Moreover, in the following claims, the terms "first," "second," and "third," etc. are used merely as labels, and do not impose numerical requirements on their objects. Further, the limitations of the following claims are not written in means-plus-function format and are not intended to be interpreted based on 35 U.S.C. § 112 (f), unless and until such claim limitations expressly use the phrase "means for" followed by a statement of function devoid of further structure.

This written description uses examples to disclose several embodiments of the subject matter, including the best mode, and to enable one of ordinary skill in the art to practice the embodiments of subject matter, including making and using any devices or systems and performing any incorporated methods. The patentable scope of the subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A vehicle control system, comprising:

a first controller including one or more processors configured to control operation of a first vehicle, the first controller operably coupled with a first communication system of the first vehicle; and a second controller including one or more processors configured to control operation of a second vehicle, the second controller operably coupled with a second communication system of the second vehicle, the first controller configured to determine an orientation of the second vehicle relative to an orientation of the first vehicle and identify a type of the second vehicle, the first controller configured to generate a first set of vehicle control signals based at least in part on the orientation of the second vehicle and the type of the second vehicle, the first communication system configured to communicate the first set of vehicle control signals with the second communication system, wherein the first controller is configured to override control of the second vehicle by the second controller to control operation of the first vehicle and the second vehicle according to the first set of vehicle control signals.

2. The vehicle control system of claim 1, wherein the first controller is configured to receive one or more signals from the second controller, the first controller configured to determine the orientation of the second vehicle relative to the orientation of the first vehicle based at least in part on the one or more signals.

3. The vehicle control system of claim 1, wherein the first communication system is communicatively coupled with the second communication system via one or more of a wired communication pathway or a wireless communication pathway.

4. The vehicle control system of claim 1, wherein the first controller is configured to remotely control operation of the second vehicle via the first set of vehicle control signals.

5. The vehicle control system of claim 1, wherein the first vehicle is configured to operate at a first operating setting and the second vehicle is configured to operate at the first operating setting based at least in part on the first set of vehicle control signals.

6. The vehicle control system of claim 5, wherein a propulsion system of the first vehicle is configured to generate a first amount of tractive effort responsive to the first vehicle operating at the first operating setting and a propulsion system of the second vehicle is configured to generate a second amount of tractive effort responsive to the second vehicle operating at the first operating setting.

7. The vehicle control system of claim 6, wherein the first amount of tractive effort configured to be generated by the propulsion system of the first vehicle is configured to be combined with the second amount of tractive effort configured to be generated by the propulsion system of the second vehicle to control movement of a load operably coupled with the first and second vehicles.

8. The vehicle control system of claim 6, wherein the first controller is configured to determine that the propulsion system of the first vehicle is the same as the propulsion system of the second vehicle based at least in part on the type of the second vehicle, wherein the first amount of tractive effort generated by the propulsion system of the first vehicle operating at the first operating setting is substantially the same as the second amount of tractive effort generated by the propulsion system of the second vehicle operating at the first operating setting.

9. The vehicle control system of claim 6, wherein the first controller is configured to determine that the propulsion system of the first vehicle is different than the propulsion system of the second vehicle based at least in part on the type of the second vehicle, wherein the first amount of tractive effort generated by the propulsion system of the first vehicle operating at the first operating setting is different than the second amount of tractive effort generated by the propulsion system of the second vehicle operating at the first operating setting.

10. The vehicle control system of claim 1, wherein the first vehicle is operably coupled with the second vehicle via a coupling system.

11. The vehicle control system of claim 1, wherein the first controller is configured to receive one or more signals from the second controller indicative of one or more operating conditions of the second vehicle responsive to the second vehicle operating according to the first set of vehicle control signals.

12. The vehicle control system of claim 11, wherein the first controller is configured to generate a second set of vehicle control signals based at least in part on the one or more signals received from the second controller, wherein the first communication system is configured to communicate the second set of vehicle control signals to the second communication system, wherein the first controller is configured to override control of the second vehicle by the second controller to control operation of the first vehicle and the second vehicle according to the second set of vehicle control signals.

13. A method, comprising:

communicatively coupling a first communication system of a first vehicle with a second communication system of a second vehicle;

determining an orientation of the second vehicle relative to an orientation of the first vehicle;

identifying a type of the second vehicle;

generating a first set of vehicle control signals with a first controller based at least in part on the orientation of the second vehicle and the type of the second vehicle;

communicating the first set of vehicle control signals with a second communication system of the second vehicle, the second vehicle including a second controller configured to control operation of the second vehicle; and overriding control of the second vehicle by the second controller to control operation of the first vehicle and the second vehicle according to the first set of vehicle control signals.

14. The method of claim 13, further comprising remotely controlling operation of the second vehicle via the first set of vehicle control signals.

15. The method of claim 13, further comprising:

receiving one or more signals from the second controller; and determining the orientation of the second vehicle relative to the orientation of the first vehicle based at least in part on the one or more signals.

16. The method of claim 13, further comprising:

operating the first vehicle at a first operating setting based at least in part on the first set of vehicle control signals; and operating the second vehicle at the first operating setting based at least in part on the first set of vehicle control signals.

17. The method of claim 16, further comprising:

generating a first amount of tractive effort with a propulsion system of the first vehicle responsive to the first vehicle operating at the first operating setting; and generating a second amount of tractive effort with a propulsion system of the second vehicle responsive to the second vehicle operating at the first operating setting.

18. The method of claim 17, further comprising:

combining the first amount of tractive effort generated by the propulsion system of the first vehicle with the second amount of tractive effort generated by the propulsion system of the second vehicle; and controlling movement of a load operably coupled with the first and second vehicles with the combined first and second amounts of tractive effort.

19. The method of claim 17, further comprising:

determining that the propulsion system of the first vehicle is different than the propulsion system of the second vehicle based at least in part on the type of the second vehicle;

generating the first amount of tractive effort with the propulsion system of the first vehicle responsive to the first vehicle operating at the first operating setting; and generating the second amount of tractive effort with the propulsion system of the second vehicle responsive to the second vehicle operating at the first operating setting, wherein the first amount of tractive effort generated by the propulsion system of the first vehicle is different than the second amount of tractive effort generated by the propulsion system of the second vehicle.

20. A vehicle control system, comprising:

a first controller including one or more processors configured to control operation of a first vehicle;

a first communication system configured to be disposed onboard the first vehicle;

a second controller including one or more processors configured to control operation of a second vehicle; and a second communication system configured to be disposed onboard the second vehicle, the first controller configured to determine an orientation of the second vehicle relative to an orientation of the first vehicle, the first controller configured to identify a type of the second vehicle, the first controller configured to generate a first set of vehicle control signals based at least in part on the orientation of the second vehicle and the type of the second vehicle, the first communication system configured to communicate the first set of vehicle control signals with the second communication system, the first controller configured to control operation of a propulsion system of the first vehicle according to the first set of vehicle control signals to generate a first amount of tractive effort, the first controller configured to override control of a propulsion system of the second vehicle by the second controller to control operation of the propulsion system of the second vehicle according to the first set of vehicle control signals to generate a second amount of tractive effort, and wherein the first amount of tractive effort is configured to be combined with the second amount of tractive effort to control movement of a load operably coupled with the first and second vehicles.

* * * * *